US005572900A

United States Patent [19]

Ayeni

[11] Patent Number: 5,572,900

[45] Date of Patent: Nov. 12, 1996

[54] REDUCED RECOIL BUCKING BAR

[75] Inventor: Tokunbo I. Ayeni, Anaheim, Calif.

[73] Assignee: The Deutsch Company, Los Angeles, Calif.

[21] Appl. No.: 283,579

[22] Filed: Aug. 1, 1994

[51] Int. Cl.[6] ..... B21J 15/40

[52] U.S. Cl. ..... 72/453.19; 72/479; 72/481.1; 72/482.2; 29/243.54

[58] Field of Search ..... 72/482, 479, 453.17, 72/453.19, 481, 463, 481.2, 481.1; 29/243.54, 243.53

[56] References Cited

U.S. PATENT DOCUMENTS

| | | | |
|---|---|---|---|
| D. 272,708 | 2/1984 | Gidlund et al. . | |
| 838,878 | 10/1906 | Gunnell | 72/482 |
| 1,100,230 | 6/1914 | Detwiler | 72/479 |
| 2,274,091 | 2/1942 | Pavlecka et al. | 72/482 |
| 2,321,225 | 6/1943 | McIntire . | |
| 2,349,341 | 5/1944 | Disse . | |
| 2,354,914 | 8/1944 | Goldstein | 72/479 |
| 2,396,413 | 3/1946 | Egger . | |
| 2,417,490 | 3/1947 | Hewes . | |
| 2,451,063 | 10/1948 | Brown . | |
| 2,512,532 | 6/1950 | Sargent et al. . | |
| 2,519,308 | 8/1950 | Brown . | |
| 3,124,981 | 3/1964 | Hedden et al. | 72/453.17 |
| 3,478,567 | 11/1969 | Galutia . | |
| 3,554,427 | 1/1971 | Steggles . | |
| 3,696,501 | 10/1972 | Burtin | 72/465 |
| 4,218,911 | 8/1980 | Johnston . | |
| 4,380,923 | 4/1983 | Emmerich . | |
| 4,398,411 | 8/1983 | Emmerich . | |

*Primary Examiner*—David Jones

*Attorney, Agent, or Firm*—Pretty, Schroeder, Brueggemann & Clark

[57] ABSTRACT

The invention provides a reduced recoil bucking bar and corresponding methods for forming joints with rivets. The bucking bar includes a housing and a driven member movable with respect to the housing. The worker using the bar holds it with the driven member pressed against one end of the rivet. When blows are delivered from the hammer through the rivet to the bar, an appropriate reaction force is generated automatically by mechanisms within the bar. These mechanisms include at least a first pressure chamber and an exhaust port for releasing pressure from the pressure chamber to the atmosphere. By controlling the flow of air through the pressure chamber, the mechanisms within the bucking bar control the forces acting on the driven member during the recoil and rebound motions. Preferred control mechanisms include a second pressure chamber and a movable shuttle. The shuttle is initially biased in a preferred direction by a biasing element in the form of a coil spring. Subsequent movement of the shuttle is dependent upon the characteristics of the hammer blow. Generation of reaction force within the bucking bar is in turn dependent on the position and motion of the shuttle. Preferably, the shuttle acts as part of several valves controlling the flow of pressurized air into and out of the two pressure chambers. A piston fixed to the end of the driven member acts as part of another valve for controlling the flow of pressurized air into the first pressure chamber.

18 Claims, 5 Drawing Sheets

REDUCED RECOIL BUCKING BAR

BACKGROUND OF THE INVENTION

The invention relates to pneumatic devices and especially to compressed air driven tools. More particularly, the invention provides a compressed air driven bucking bar for use in forming joints with rivets. The invention provides a reduced recoil bucking bar that operates more efficiently and is less fatiguing to the user in comparison with previous devices.

Rivets are commonly used to form strong and secure joints between parts in buildings, aircraft, and numerous other structures and machines. To form a riveted joint, the two parts to be joined are brought together and a rivet is placed through the two parts through a common predrilled rivet hole. The rivet has a rounded head that bears against one of the parts, and an elongate shank that projects out of the rivet hole on the other side of the joint.

A pneumatic riveting hammer is pressed against the rivet on one side of the joint, usually against the head of the rivet. At the same time, a bucking bar is held against the shank of the rivet on the other side of the joint. When the hammer is actuated, it delivers a series of sharp impacts to the head of the rivet. These impacts send a shock wave down the length of the shank to the bucking bar at the other end.

When the shock wave reaches the end of the rivet, a portion of the energy is retained in the rivet, with the remaining portion transferred to the bucking bar. The energy retained in the rivet is absorbed in part by deforming the rivet. As the rivet deforms, a rounded head is formed on the shank to retain the rivet in the hole and secure the two parts together.

Of the energy transferred to the bucking bar, a portion is transferred back into the rivet, and another portion is absorbed by the bucking bar itself. The remaining energy flows into the hands of the worker holding the bucking bar, principally in the form of shock and vibration.

Formerly, solid metal bars were used as bucking bars. Unfortunately, relatively little energy was absorbed or returned to the rivet by the solid bar. Thus, a relatively large portion of the energy entering the bucking bar had to be absorbed by the worker. Not only did the worker holding the bar fatigue quickly, but the large shock and vibration amplitudes made it difficult to hold the bucking bar in place against the rivet.

For more efficient rivet forming, it is desirable to increase the proportion of energy returned from the bucking bar back into the rivet. This increases the rate at which the shank is deformed to form the rounded head on the rivet so that riveting is accomplished more quickly. To decrease the fatigue experienced by the worker using the bucking bar, the amount of energy transferred to the worker should be reduced. This can be accomplished by increasing the amount of energy returned to the rivet from the buckling bar, and by increasing the amount of energy absorbed by the bucking bar.

Efforts have been made to devise improved bucking bars which would reduce shock and vibration experienced by the worker while allowing more rapid and efficient riveting. For example, U.S. Pat. No. 2,512,532 to Sargent et al and U.S. Pat. No. 2,519,308 to Brown each describe bucking bars in which the shock wave from riveting acts on a mass that in turn compresses one or more springs within a cylindrical handle held by the worker. Compressing the spring stores energy; a portion of this energy is returned to the rivet when the spring rebounds the mass back against the rivet. Additionally, some energy is absorbed by the bucking bar in the form of heat produced in compressing the spring, and in moving the mass against frictional resistance in the cylinder.

A somewhat different approach is taken in the bucking bar described in U.S. Pat. No. 4,380,923 to Emmerich. A connection is provided between the bucking bar and an external supply of pressurized air. The air is used to pressurize an internal chamber that lies behind a piston connected to the impact head of the bucking bar. When a blow is delivered by the hammer to the rivet, energy passing from the rivet into the bucking bar forces the piston backward, thereby compressing the pressurized air in the pressure chamber. The air acts as a spring storing energy for return to the rivet as the piston recoils from the blow. Additionally, some energy is absorbed in compressing the air, and in sliding the piston against frictional resistance.

The device disclosed in the '923 patent includes a knob for adjusting the pressure of the air in the pressure chamber behind the piston. The '923 patent discloses that by turning the knob, the pressure in the chamber can be adjusted to minimize the vibration experienced by the worker. The '923 patent suggests that the knob be adjusted by the worker mainly on the basis of trial and error, with adjustments being made manually on the basis of a test run and from time-to-time as the riveting operation proceeds.

It would be desirable to devise a bucking bar that would automatically provide near optimal functioning under a wide variety of conditions, without manual adjustment or other intervention being required of the worker using the bar. It would be desirable if the bucking bar could in some way "sense" the impact transferred from the rivet and adjust itself so as to provide the proper resistance and recoil force. It would be further desirable to devise a bucking bar capable of absorbing an increased amount of energy, so that the energy delivered into the hands of the worker could be decreased accordingly.

SUMMARY OF THE INVENTION

The invention provides a reduced recoil bucking bar and corresponding methods for forming joints with rivets. The bucking bar provides for more efficient riveting and reduces shock and vibration transmitted to the worker using the bar.

According to the invention, the bucking bar includes a housing and a driven member movable with respect to the housing. In a preferred embodiment, the driven member lies within a central bore within the housing.

When riveting, the worker using the bar holds it with the driven member pressed against one end of the rivet. When blows are delivered to the other end of the rivet by the riveting hammer, the bucking bar initially allows the driven member to recoil away from the rivet. After the initial recoil, mechanisms within the bucking bar return the driven member back into contact with the rivet before the next blow from the hammer.

Energy delivered to the bar with each blow of the hammer is in part returned to the rivet and in part absorbed by the bar during the recoil and return motions of the driven member. Only a relatively small portion of the energy entering the bar is transmitted to the worker. For this reason, the bucking bar of the invention can be described as a "reduced recoil" bucking bar. Although the driven member recoils from the hammer blow, relatively little of this recoil is passed on to the worker using the bar.

The recoil and return motions of the driven member are controlled in part by mechanisms within the bar. These mechanisms generate a reaction force appropriate for the particular blow delivered by the hammer. A particularly forceful hammer blow is met by a strong reaction force; a less severe blow generates a milder reaction force.

The mechanisms generating the reaction force within the bar include at least a first pressure chamber and an exhaust port for releasing pressure from the pressure chamber to the atmosphere. Recoil of the driven member is first resisted by pressure within the pressure chamber. After the initial recoil, pressure within the pressure chamber provides a force to rebound the driven member back into contact with the rivet. By controlling the flow of air into and out of the pressure chamber, the mechanisms within the bucking bar control the forces acting on the driven member during the recoil and rebound motions.

In the preferred embodiment described, the control mechanisms include a second pressure chamber and a movable shuttle exposed to pressure from both the first and second pressure chambers. The shuttle is initially biased in a direction tending to increase pressure in the first pressure chamber by a biasing element in the form of a coil spring. Movement of the shuttle within the bucking bar is dependent upon the character of the hammer blow transmitted to the bar from the rivet. Generation of reaction force within the bucking bar is in turn dependent on the position and motion of the shuttle.

In the preferred embodiment, the shuttle acts as a part of several valves controlling the flow of pressurized air into and out of the two pressure chambers. Similarly, a piston fixed to the end of the driven member and exposed to pressure within the first pressure chamber acts as a part of a valve controlling the flow of pressurized air into the first pressure chamber.

Other features and advantages of the present invention will become apparent from the following detailed description of the preferred embodiment, taken in conjunction with the accompanying drawings, which illustrate by way of example the principles of the invention.

DESCRIPTION OF THE PREFERRED EMBODIMENTS

Figure 1:
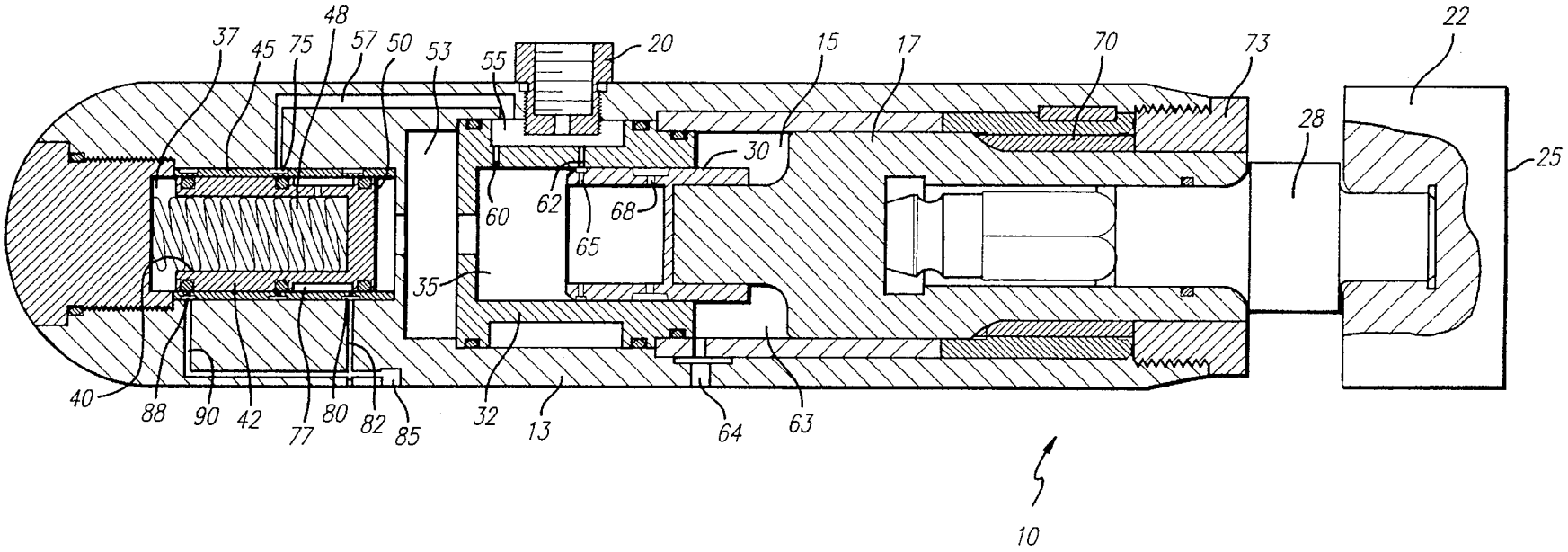
FIG. 1 is a side sectional view of a reduced recoil bucking bar according to the invention.

FIG. 1 provides a side sectional view of a reduced recoil bucking bar according to the invention. As depicted therein, the bucking bar 10 comprises a housing 13 having a central bore 15, and a driven member 17 reciprocatably disposed within the bore of the housing.

The housing 13 is shaped and sized so that it can be gripped and held conveniently by the worker doing the bucking. The housing 13 is provided with a connection 20, which provides a secure connection to an air hose from a compressor or a compressed air tank.

The driven member 17 comprises a head 22 having a striking face 25 for striking the rivet, a shaft 28 fixed to the head 22, and a piston 30 at the end of the shaft 28 opposite the head 22. The piston 30 slides within a piston sleeve 32 fixed inside the central bore 15 of the housing 13. Together, the piston 30 and the piston sleeve 32 define a first pressure chamber 35 whose volume changes as the piston 30 and the rest of the driven member 17 move back and forth within the bore 15 of the housing 13.

A second pressure chamber 37 is located in the housing 13 behind the first pressure chamber 35. The second pressure chamber 37 is defined by the housing 13, and by an interior surface 40 of a shuttle 42. The shuttle 42 is movable within a shuttle sleeve 45 fixed inside the housing. The volume of the second pressure chamber 37 changes as the shuttle 42 slides back and forth inside the shuttle sleeve 45. A compressed coil spring 48 biases the shuttle 42 in a direction towards the first pressure chamber 35.

The shuttle 42 is exposed on its interior surface 40 to pressure within the second pressure chamber 37. This pressure tends to move the shuttle 42 in a direction towards the first pressure chamber 35. Additionally, the coil spring 48 exerts a force on the shuttle 42 in the same direction. These forces are countered by pressure within the first pressure chamber 35. A front surface 50 of the shuttle 42 is exposed to pressure in the first pressure chamber 35 through an intermediate chamber 53 within the housing 13. Thus, the position and motion of the shuttle 42 are influenced by forces from pressure in the second pressure chamber 37, from the coil spring 48, and from pressure in the first pressure chamber 35.

Pressurized air is supplied to the bucking bar through the connection 20 on the exterior of the housing 13. Pressurized air flows to the piston sleeve 32 through a channel 55 and to the shuttle sleeve 45 through a side channel 57. Pressure is communicated into the first pressure chamber 35 at least through a first inlet 60 in the piston sleeve 32. Pressure is also be applied to the first pressure chamber 35 through a second inlet 62 if second inlet 62 is at that time aligned either with a first opening 65 or the second opening 68 through the piston 30. Pressure in the first pressure chamber 35 drives the piston 30 outward. This extends the driven member 17 out of the bore 15 until a collar 70 around the shaft 28 contacts a retaining ring 73 near the end of the bore.

At the same time, pressure in the first pressure chamber 35 is communicated through the intermediate chamber 53 to the front surface 50 of the shuttle 42. Pressure is also supplied through the side channel 57 to a shuttle inlet 75 on the shuttle sleeve 45.

Figure 1A:
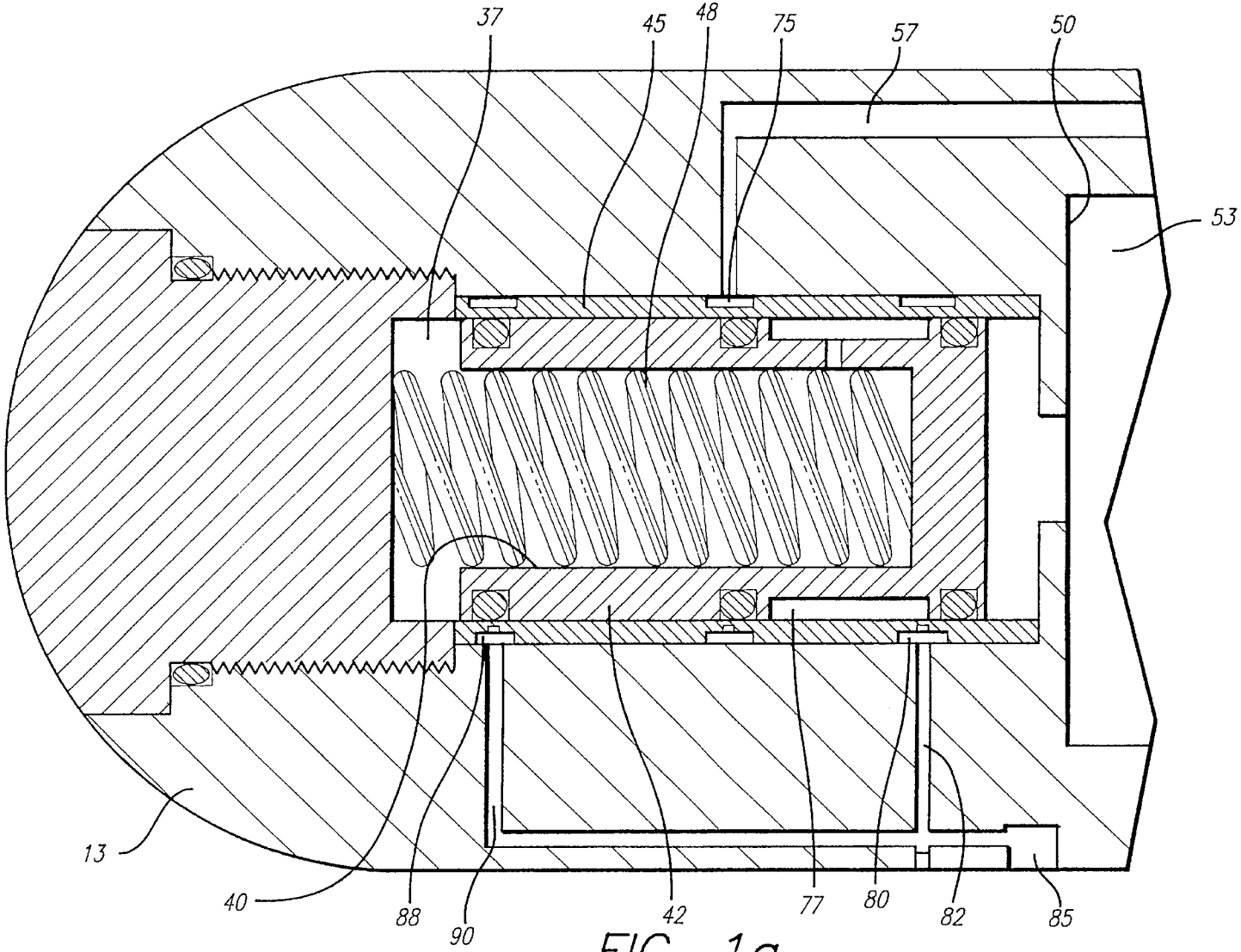
FIG. 1*a* is an enlarged side sectional view of a portion of the bucking bar of FIG. 1.

The forces acting on the shuttle 42 move the shuttle into the position shown in FIG. 1*a*. The position of shuttle 42 and the forces acting on the shuttle can best be understood with reference to FIG. 1*a*. The shuttle 42 is initially biased towards the first pressure chamber 35 by the coil spring 48, and by pressure in the second pressure chamber 37. This bias is opposed by pressure acting on the front surface 50 of the shuttle 42. Should the shuttle 42 move forward significantly beyond the position shown in FIG. 1*a*, pressure within the second pressure chamber 37 will be reduced as lair is vented through an opening 77 on the shuttle, through a front shuttle outlet 80 on the shuttle sleeve 45, continuing through a first exhaust channel 82 in the housing 13, and finally out an exhaust port 85 to the atmosphere. If the shuttle 42 moves even farther forward, still more air will be vented from the second pressure chamber 37 through a rear shuttle outlet 88, a second exhaust channel 90, and finally through the exhaust port 85 to the atmosphere.

As pressure is vented from the second pressure chamber 37, the balance will be restored between the pressure in the second pressure chamber 37 and the force of the spring on one side of the shuttle, and the pressure in the first pressure chamber on the other. As this balance is restored, the shuttle 42 will move rearward in the shuttle sleeve 45 and back to the position shown in FIG. 1*a*.

Should the shuttle 42 move rearward much beyond the position shown in FIG. 1*a*, pressure will be added to the second pressure chamber 37 from the side channel 57 through the inlet 75 on the shuttle sleeve 45 and continuing into the second pressure chamber 37 through the opening 77 in the shuttle 42. If the shuttle moves still farther rearward, pressure will be vented from the first pressure chamber 35 through the intermediate chamber 53 through the front shuttle outlet 80 and the first exhaust channel 82, and finally to the atmosphere through the exhaust port 85.

The shuttle 42 forms a part of a number of valves within the bucking bar. First, the shuttle cooperates with the front shuttle outlet 80 to form a valve that releases pressure from the first pressure chamber 35 in response to a relative increase in pressure between the first pressure chamber and the second pressure chamber 37. Similarly, the shuttle 42 combines with the rear shuttle outlet 88 to form a valve that releases pressure from the second pressure chamber 37 in response to an increase in pressure in the second pressure chamber relative to the pressure in the first pressure chamber 35. Finally, the shuttle 42 and the inlet 75 together form a valve that allows air into the second pressure chamber 37 through the opening 77 in response to a decrease in pressure in the second pressure chamber 37 relative to the pressure in the first pressure chamber 35.

From the above, it will be appreciated that any appreciable deviation of the shuttle 42 from the position depicted in FIG. 1*a* will give rise to one or more restoring forces that will tend to urge the shuttle 42 back into substantially the position depicted. As the shuttle moves in response to the forces acting on it, reaction forces are generated within the bucking bar appropriate to the nature of the riveting force acting on the bar. This behavior is discussed in detail below.

FIG. 1 depicts the bucking bar with the driven member 17 fully extended after air pressure is supplied through the connection 20. The bucking bar is now ready for riveting to begin. To begin riveting, the worker using the bucking bar holds it in position with the striking face 25 against the exposed end of the rivet. The riveting hammer is then operated to deliver a series of sharp blows to the other end of the rivet. As the shock wave created by each blow leaves the rivet at the end opposite the hammer, energy is delivered to the bucking bar. For efficient riveting, as much of this energy as possible should be returned to the rivet. Of the energy remaining, the greater portion of it should be absorbed by the bucking bar, with relatively little energy passed to the worker.

The energy delivered to the striking face 25 drives the driven member 17 backwards with respect to the housing 13. The impulse and velocity imparted to the driven member 17 are dependent on the characteristics of the rivet and of the hammer being employed. The backwards motion of the driven member 17 must be resisted by a reaction force generated within the bucking bar. Ideally, this reaction force should be matched to the size and character of the impact delivered to the driven member 17. A large impact requires a large reaction force sufficient to return the striking face 25 of the driven member 17 into contact with the rivet before the next blow is delivered by the hammer. A smaller impact will be resisted best by a smaller reaction force, so that the shock delivered to the worker is minimized.

Figure 2:
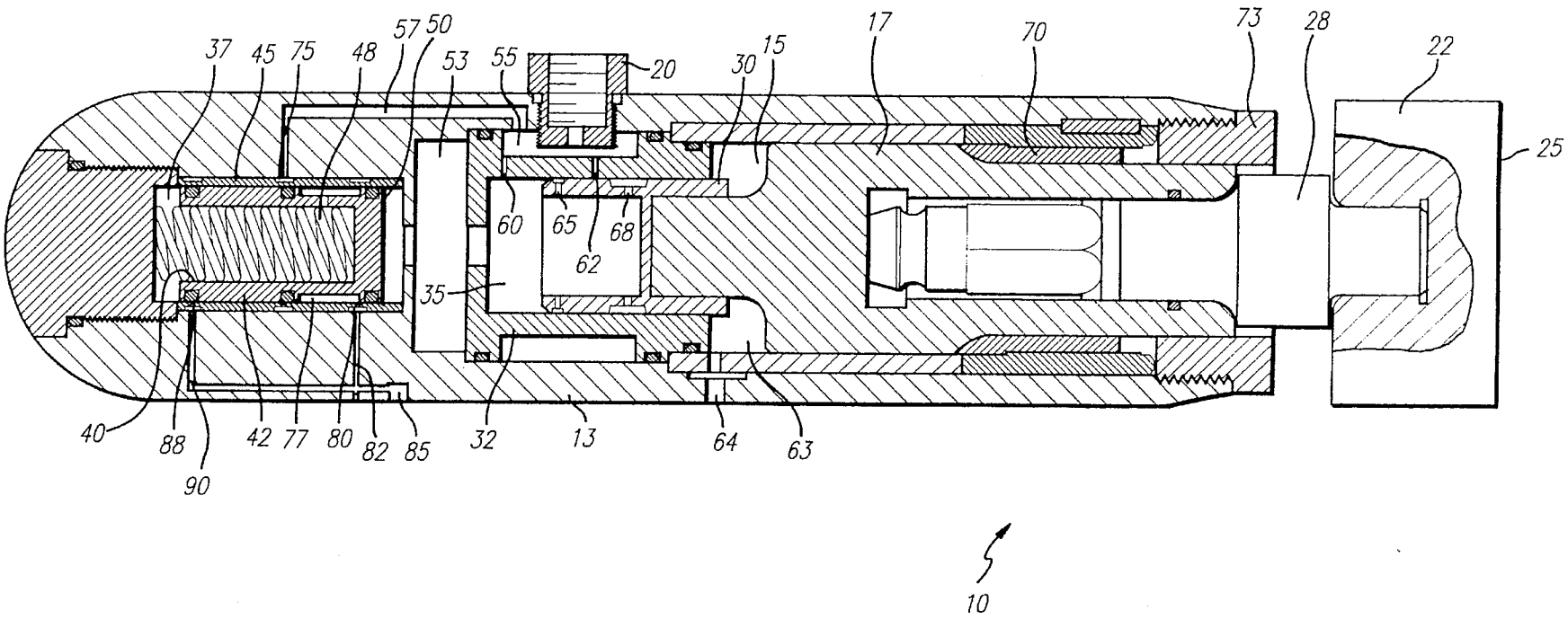
FIG. 2 is a side sectional view of the bucking bar of FIG. 1, at a time shortly after a blow has been struck by the riveting hammer.

In the bucking bar of the invention, backwards motion of the driven member 17 compresses the air in the first pressure chamber 35 as the piston 30 moves backwards within the piston sleeve 32. FIG. 2 depicts the bucking bar just after a blow has been imparted to the rivet by the hammer. Careful comparison of FIG. 2 with FIG. 1 reveals that the shock wave entering the striking face 25 has driven the shaft 28 and the piston 30 backwards within the housing 13. In particular, the piston 30 has moved backward so that the second inlet 62 is now sealed off by the piston 30.

Figure 1B:
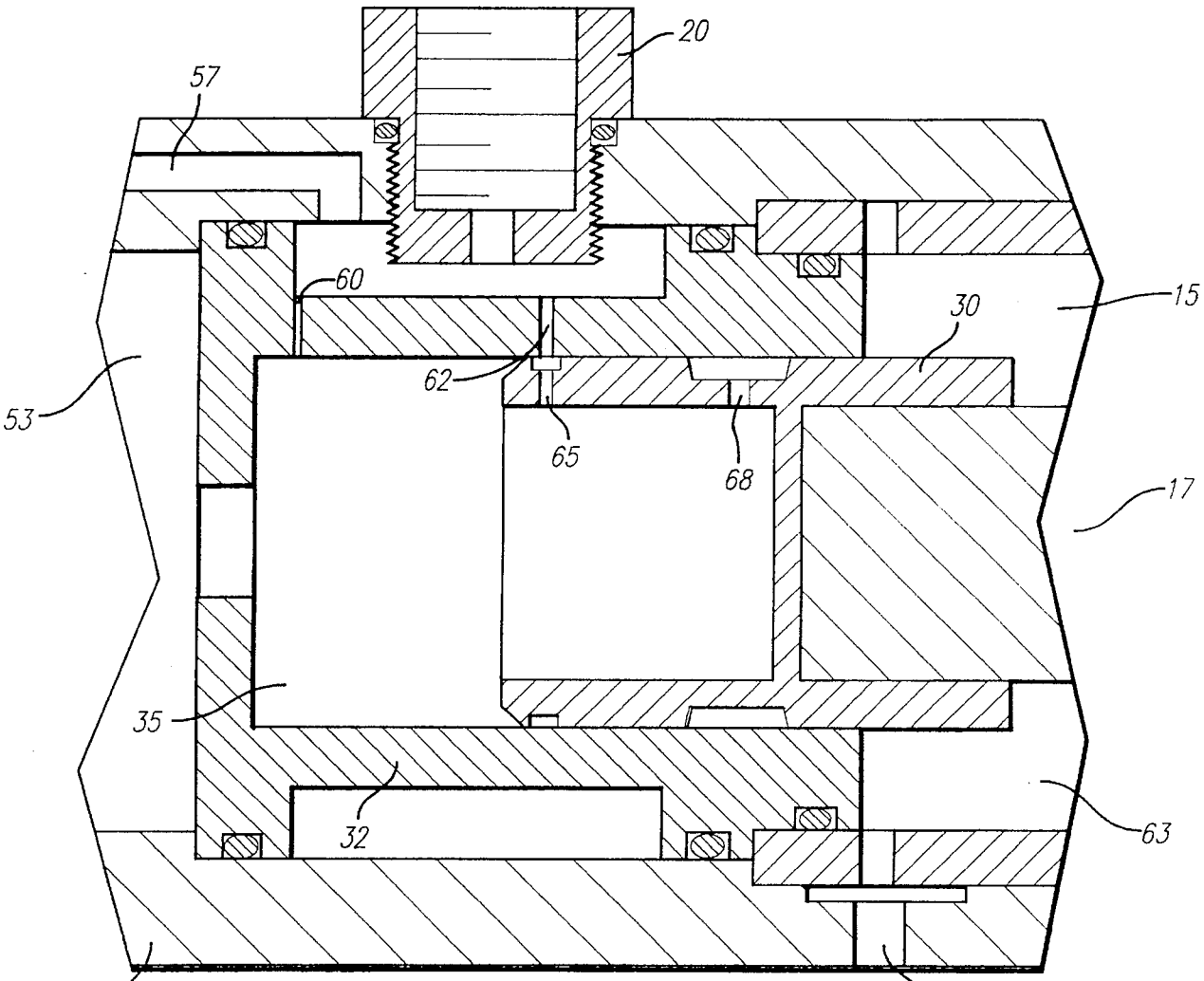
FIG. 1*b* is an enlarged side sectional view of a portion of the bucking bar of FIG. 1.

Although the first pressure chamber 35 is still open through the first inlet 60, the flow of air in and out of the first pressure chamber 35 is greatly restricted in comparison with the condition depicted in FIG. 1. In FIG. 1, air can enter or leave the first pressure chamber through both the first inlet 60 and the second inlet 62. In FIG. 2, air can enter or leave the first pressure chamber only through the first inlet 60, which typically has a cross-sectional area substantially less than that of the second inlet 62 (see FIG. 1*b*). In this way, the piston 30 acts as part of a valve (cooperating with the first inlet 60 and the second inlet 62). This valve controls the flow of air into the first pressure chamber 35 depending on the relative positions of the piston 30 and the piston sleeve 32.

As the piston moves backward, air in the first pressure chamber is both compressed and forced backward into the intermediate chamber 53. Simultaneously, air within an interiorspace 63 is forced out of the bar through an outlet 64 to the atmosphere. As the air in the first pressure chamber 35 is compressed, energy is stored in that air for later return as the piston 30 and the driven member 17 rebound against the rivet. In addition, some energy is absorbed as heat by the air in the first pressure chamber 35. More energy is absorbed as the pressurized air is forced backward out of the first pressure chamber 35 through the intermediate chamber 53. Additional energy is absorbed in forcing air out of the interior space 63 through the outlet 64.

Figure 3:
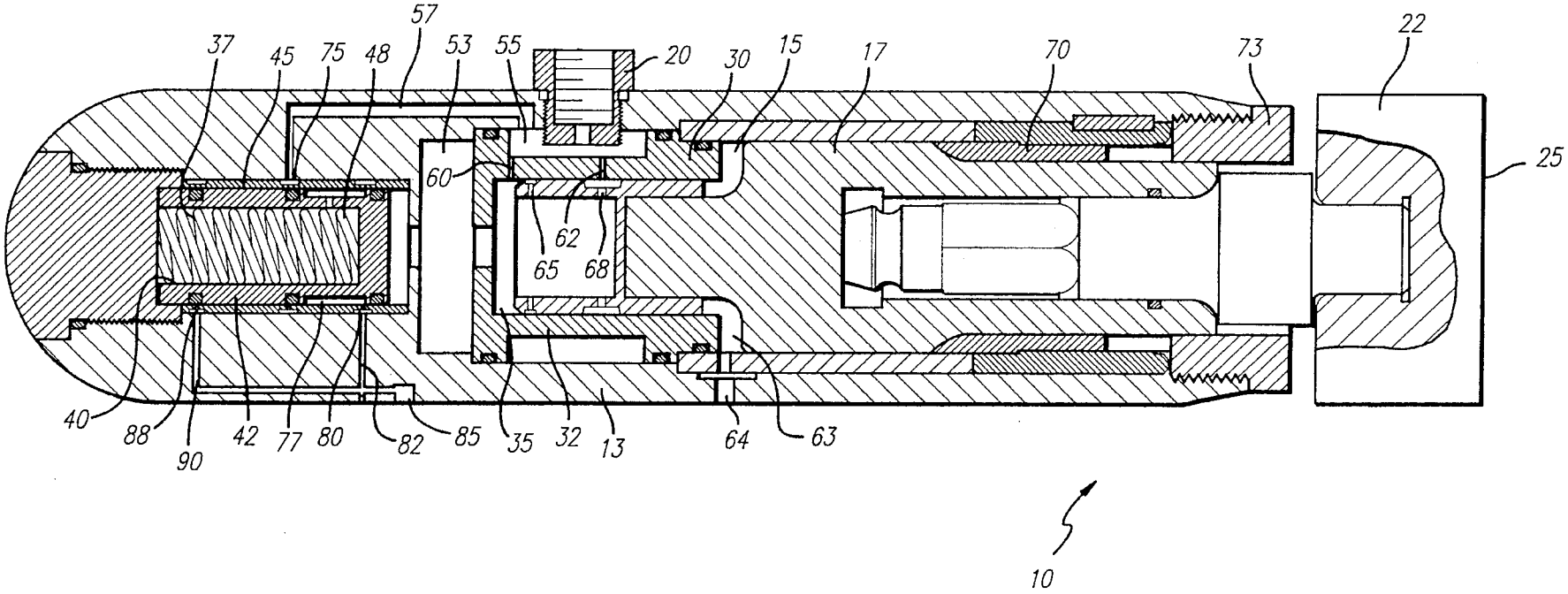
FIG. 3 is a side sectional view of the bucking bar depicted in FIGS. 1 and 2, at a time shortly after the depiction of FIG. 2.

Air exiting the first pressure chamber 35 through the intermediate chamber 53 presses against the front surface 50 of the shuttle 42. As the pressure against the front surface 50 of the shuttle 42 increases, the shuttle 42 is driven backwards against the force from the coil spring 48, and against the pressure in the second pressure chamber 37. FIG. 3 depicts the bucking bar at a time shortly after the depiction of FIG. 2. As shown in FIG. 3, the shaft 28 and the piston 30 have moved still further backward within the bore 15. The first pressure chamber 35 is exposed once again to air both from the first inlet 60, and from the second inlet 62 (through the front piston opening 68).

Referring still to FIG. 3, the shuttle 42 has been forced backward by pressure acting on the front surface 50 of the shuttle against the combined force of the coil spring 48 and pressure within the second pressure chamber 37. In the position shown, pressurized air is being added from the inlet 75 through the shuttle opening 77 to resist further backward motion of the shuttle 42. If the blow imparted to the driven member 17 is sufficiently large, the shuttle 42 will continue moving backward until the front outlet 80 is opened (as shown), thereby allowing pressure from the first pressure chamber 35 to vent out through the exhaust port 85.

This venting not only decreases the pressure on the front surface 50 of the shuttle 42, thereby hastening the return of the shuttle 42 to its normal position, but also absorbs energy as pressurized air is forced outward to the atmosphere through the restricted first exhaust channel 82. Venting pressurized air from the first pressure chamber 35 to the atmosphere is advantageous because discharging energy in the form of heated air to the atmosphere lessens the tendency for heat to build up in the bucking bar itself.

As the driven member 17 continues moving backward, the combined force of the coil spring 48 and pressure in the second pressure chamber 37 will reverse the backward motion of the shuttle 42 and begin moving the shuttle forward in the direction of the first pressure chamber. At first, this squeezes more air out of the region just forward of the shuttle 42 through the front outlet 80 and the exhaust port 85, thereby absorbing and releasing more energy to the atmosphere. As the shuttle 42 continues to move forward, the front outlet 80 is closed off by the shuttle (refer back to FIG. 2), and further forward motion of the shuttle raises the pressure in the first pressure chamber 35.

If the blow is a severe one, the driven member 17 will continue moving backward to a point where the second inlet 62 is aligned with the second piston opening 68 (as shown in FIG. 3). When this occurs, pressurized air will be added to the first pressure chamber 35 from the connection 20 through both the first inlet 60 and the second inlet 62. Eventually, the air pressure in the first pressure chamber 35 will counter the rearward motion of the driven member 17 and the driven member 17 will return to its extended position (depicted in FIG. 1) with the striking face 25 ready to receive the next shock wave when the hammer delivers the next blow to the rivet. When the driven member impacts the rivet on its forward stroke, energy is returned from the bucking bar to the rivet. This energy assists in deforming the rivet, thereby providing for quicker and more efficient riveting than would otherwise be the case.

The configuration described results in the automatic generation of an appropriate reaction force to counter a wide range of impacts. For example, a relatively severe impact force will drive the driven member backward very forcefully. This in turn will cause the shuttle to be driven backwards quite rapidly. As a result, the front outlet 80 will be open for a substantial period of time and a relatively large amount of air will be forced out of the first pressure chamber 35 during this time. Correspondingly, the shuttle opening 77 will be aligned with the shuttle inlet 75 for a relatively long time, thereby allowing a relatively large amount of air to enter the second pressure chamber 37, so that the shuttle 42 is returned forcefully to quickly compress the air in the first pressure chamber 35, thereby helping to return the driven member into contact with the rivet. Lesser impacts will generate correspondingly less forceful motion of the driven member 17 and the shuttle 42, and lesser reaction forces will be generated thereby.

The configurations and relative motions of the piston 30, the shuttle 42, the coil spring 48, and all of the various air passages provide for an improved bucking bar in which the reaction force generated within the bar is automatically matched to the impact imparted to the driven member, without adjustments or other intervention by the worker. Additionally, a relatively large portion of the energy imparted to, the driven member is returned to the rivet when the driven member impacts the rivet on its return stroke. This substantially lessens the time taken to deform the rivet. Finally, the bar is capable of absorbing and discharging to the atmosphere a greater amount of energy than in prior art bucking bars, thereby reducing shock, vibration and fatigue experienced by the worker.

A preferred embodiment of a reduced recoil bucking bar according to the invention has been described above. However, additions and modifications may be made by those skilled in the art without departing in any material way from the spirit of the invention. For example, although terms such as "front" and "rear" are used above to describe various features of the invention, the relative positions of those features could be changed without changing the functions of those features with respect to one another, or with respect to the invention as a whole. Other modifications will no doubt occur to those skilled in the art. Therefore, the scope of the invention should be determined primarily by reference to the appended claims, along with the full scope of equivalents to which those claims are legally entitled.

What is claimed is:

1. A recoilless bucking bar comprising:

a housing;

a driven member movable with respect to said housing;

structure defining a first pressure chamber;

a piston fixed to said driven member, said piston exposed to gas pressure within said first pressure chamber;

structure defining an exhaust port for releasing pressure from said first pressure chamber to the atmosphere;

structure defining a second pressure chamber; and a shuttle having two sides, said shuttle being exposed on one side to pressure from within said first pressure chamber and on the other side to pressure from within said second pressure chamber.

2. The apparatus of claim 1, further comprising:

structure defining an exhaust port for releasing pressure from said second pressure chamber to the atmosphere.

3. The apparatus of claim 2, wherein the exhaust port for releasing pressure from said second pressure chamber is the same exhaust port as the exhaust port for releasing pressure from said first pressure chamber.

4. The apparatus of claim 1, wherein said shuttle acts as part of a valve for releasing pressure from said first pressure chamber in response to an increase in pressure within said first pressure chamber relative to pressure within said second pressure chamber.

5. The apparatus of claim 1, wherein said shuttle acts as part of a valve for releasing pressure from said second pressure chamber in response to an increase in pressure within said second pressure chamber relative to pressure within said first pressure chamber.

6. The apparatus of claim 1, wherein said shuttle acts as part of a valve for increasing pressure within said second pressure chamber in response to a decrease in pressure within said second pressure chamber relative to pressure within said first pressure chamber.

7. The apparatus of claim 1, wherein said piston acts as part of a valve controlling the flow of a gas into said first pressure chamber in response to motion of the driven member relative to the housing.

8. The apparatus of claim 1, further comprising:

a biasing element which urges said shuttle in a direction tending to increase the pressure in said first pressure chamber.

9. A recoilless bucking bar for use with a supply of pressurized gas, the bucking bar comprising:

a housing;

a driven member movable with respect to said housing;

structure defining a first pressure chamber;

structure defining a second pressure chamber;

a piston fixed to said driven member, said piston exposed to gas pressure within said first pressure chamber a movable shuttle having two sides, said shuttle being exposed on one side to pressure within said first pressure chamber and on the other side to pressure within said second pressure chamber;

a connection on said housing for connecting the bucking bar to the supply of pressurized gas.

10. The apparatus of claim 9, further comprising:

structure defining a channel between said connection and said piston;

wherein said piston includes an opening which controls the flow of pressurized gas from the channel into said first pressure chamber depending upon the position of the piston.

11. The apparatus of claim 9, further comprising:

structure defining a channel between said connection and said shuttle;

wherein said shuttle includes an opening which controls the flow of pressurized gas from the channel into said second pressure chamber depending upon the position of the shuttle.

12. The apparatus of claim 9, further comprising:

structure defining a channel between said shuttle and the atmosphere;

wherein said shuttle is movable to a position wherein said first pressure chamber and the atmosphere are placed in fluid communication through said channel.

13. The apparatus of claim 9, further comprising:

structure defining a channel between said shuttle and the atmosphere;

wherein said shuttle is movable to a position wherein said second pressure chamber and the atmosphere are placed in fluid communication through said channel.

14. The apparatus of claim 13, wherein said shuttle is movable to a position wherein said second pressure chamber and the atmosphere are placed in fluid communication through said channel by means of an opening in said shuttle.

15. The apparatus of claim 9, further comprising:

a biasing element which urges said shuttle in a direction tending to increase the pressure in said first pressure chamber.

16. A method of bucking during installation of a rivet, the method comprising the steps of:

holding a bucking bar against the rivet;

supplying pressurized air to the bucking bar;

storing pressurized air within the bucking bar;

applying a blow to the rivet;

releasing pressurized air from the bucking bar in response to the blow applied to the rivet.

17. The method of claim 16, further comprising the step of moving a shuttle within the bucking bar in response to the blow applied to the rivet.

18. The method of claim 16, further comprising the step of releasing pressurized air from the bucking bar in response to movement of the shuttle.

* * * * *